US008496305B2

(12) United States Patent
Becker et al.

(10) Patent No.: US 8,496,305 B2
(45) Date of Patent: Jul. 30, 2013

(54) SUBWOOFER CONCEALING FURNITURE UNIT

(75) Inventors: William M. Becker, Washington, DC (US); Matthew Weatherly, Fairfax, VA (US)

(73) Assignee: Becker Designed, Inc., Chantilly, VA (US)

( * ) Notice: Subject to any disclaimer, the term of this patent is extended or adjusted under 35 U.S.C. 154(b) by 166 days.

(21) Appl. No.: 12/817,874

(22) Filed: Jun. 17, 2010

(65) Prior Publication Data

US 2011/0012481 A1 Jan. 20, 2011

Related U.S. Application Data

(60) Provisional application No. 61/226,065, filed on Jul. 16, 2009.

(51) Int. Cl.
*A47B 81/00* (2006.01)

(52) U.S. Cl.
USPC ..... 312/289

(58) Field of Classification Search
USPC ..... 312/7.2, 7.1, 8.1, 8.16, 237, 223.3, 312/223.6, 318, 285, 289; 181/199
See application file for complete search history.

(56) References Cited

U.S. PATENT DOCUMENTS

| | | | | | |
|---|---|---|---|---|---|
| 98,038 | A | * | 12/1869 | Cotter | 312/196 |
| 1,303,280 | A | * | 5/1919 | Fliedner | 108/3 |
| 1,810,568 | A | * | 6/1931 | Liebreich | 312/7.1 |
| 3,347,607 | A | * | 10/1967 | Knize | 312/8.11 |
| 3,572,873 | A | * | 3/1971 | Harting, Jr. | 312/290 |
| 3,707,201 | A | * | 12/1972 | Domin et al. | 181/145 |
| 5,306,078 | A | * | 4/1994 | Reed | 312/7.1 |
| 7,394,653 | B2 | * | 7/2008 | Cheng et al. | 361/679.48 |
| 2007/0172085 | A1 | | 7/2007 | Powers | |
| 2008/0126927 | A1 | | 5/2008 | Jha | |
| 2008/0185485 | A1 | | 8/2008 | Watanabe et al. | |
| 2009/0238384 | A1 | | 9/2009 | Beauchamp | |

* cited by examiner

*Primary Examiner* — Darnell Jayne
*Assistant Examiner* — Matthew Ing
(74) *Attorney, Agent, or Firm* — Design IP

(57) ABSTRACT

A furniture unit including a compartment that contains and conceals a subwoofer, wherein the compartment has vent openings that allow air and sound to pass freely between the subwoofer compartment and the outside of the furniture unit while concealing the subwoofer from the view of a person sitting within a typical viewing angle of a television that is placed on top of the furniture unit or mounted on the wall above the unit.

19 Claims, 13 Drawing Sheets

SUBWOOFER CONCEALING FURNITURE UNIT

CROSS-REFERENCE TO RELATED APPLICATION

This application claims the benefit of U.S. Provisional Patent Application No. 61/226,065, filed Jul. 16, 2009, which is incorporated by reference as if fully set forth.

BACKGROUND OF THE INVENTION

The invention relates to home theater furniture, particularly furniture that conceals speakers or other objects.

Typically, home theater users place their speakers and other audio or video components on shelves or on top of or within furniture units. Placement of a subwoofer within a home theater setup presents a unique problem. Because subwoofers tend to be quite large, and cause a considerable amount of vibration when operated, it is undesirable to place subwoofers inside or in contact with an audio/video ("A/V") cabinet. In addition, most conventional A/V cabinets are not designed to accommodate a subwoofer therein. Therefore, users typically place their subwoofers on the floor next to the A/V cabinet, a couch, or another article of furniture. However, it is often desirable to conceal the subwoofer from view so as to improve the overall aesthetic appearance of the A/V system.

If the subwoofer is placed behind an A/V cabinet or other article of furniture, the furniture must be spaced apart from the wall, which reduces usable floor space in the room, and the large gap between the furniture and the wall creates an undesirable appearance. On the other hand, if the subwoofer is concealed under a couch or placed such that its inlet or outlet port is covered or located near an object, the sound produced by the subwoofer will be muffled, distorted, or reduced in amplitude, and the subwoofer may overheat or malfunction.

Accordingly, there is a need for a home theater unit that effectively conceals a speaker while reducing adverse effects on sound quality and performance.

SUMMARY OF THE INVENTION

According to one embodiment of the inventive concept, a furniture unit is disclosed. The furniture unit comprises a rear wall defining a rear wall opening; first and second side walls extending forwardly from the rear wall; a top surface located atop the rear wall and the first and second side walls and being supported by at least one selected from the group of: the rear wall, the first side wall and the second side wall; a first compartment located between the first and second side walls, the first compartment having a first face that is opposite to the rear wall, a distance from the first face to the rear wall defining a unit depth, a distance from the first side wall to the second side wall defining a unit width; and a subwoofer compartment located between the first compartment and the rear wall, the subwoofer compartment communicating with the rear wall opening and having an open bottom, the subwoofer compartment being separated from the first compartment by a first divider, a distance from the rear wall to the first divider defining a subwoofer compartment depth, a distance from the first side wall to a second divider defining a subwoofer compartment width.

According to an alternative embodiment of the inventive concept, a furniture unit is disclosed. The furniture unit comprises a rear wall defining a rear wall opening; a first side wall, a second side wall and a second divider extending forwardly from the rear wall and being perpendicular to the rear wall, the second divider being located between the first side wall and the second side wall; a top surface located atop the rear wall and the first and second side walls and being supported by the rear wall, the first side wall and the second side wall; a first compartment located between the first side wall and the second divider, the first compartment having a first face that is opposite to the rear wall, a distance from the first face to the rear wall defining a unit depth, a distance from the first side wall to the second side wall defining a unit width; a subwoofer compartment located between the first side wall and the second first divider and between the first compartment and the rear wall, the subwoofer compartment communicating with the rear wall opening and having an open bottom, the subwoofer compartment being separated from the first compartment by a first divider that is parallel to the rear wall, the first side wall having a vented portion comprising at least one vent opening in communication with the subwoofer compartment, a distance from the rear wall to the first divider defining a subwoofer compartment depth, a distance from the first side wall to the second divider defining a subwoofer compartment width; a second compartment located between the second divider and the second side wall, the second compartment extending from the rear wall to a third face that is coplanar with the first face; and a center compartment located above the first compartment, the subwoofer compartment, and the second compartment, the center compartment extending from the rear wall to a second face that is co-planar with the first face.

According to a first exemplary method of the inventive concept, a method for concealing a subwoofer is disclosed. The method comprises positioning a furniture unit on a surface, the furniture unit comprising a rear wall defining a rear wall opening, first and second side walls extending forwardly from the rear wall, a top surface located atop the rear wall and the first and second side walls, a first compartment located between the first and second side walls, the first compartment having a face that is opposite to the rear wall, and a subwoofer compartment located between the first compartment and the rear wall; and positioning the subwoofer on the surface and at least partially within the subwoofer compartment.

BRIEF DESCRIPTION OF THE DRAWINGS

The present invention will hereinafter be described in conjunction with the appended drawing Figures wherein like numerals denote like elements.

DETAILED DESCRIPTION OF THE INVENTION

Figure 1:
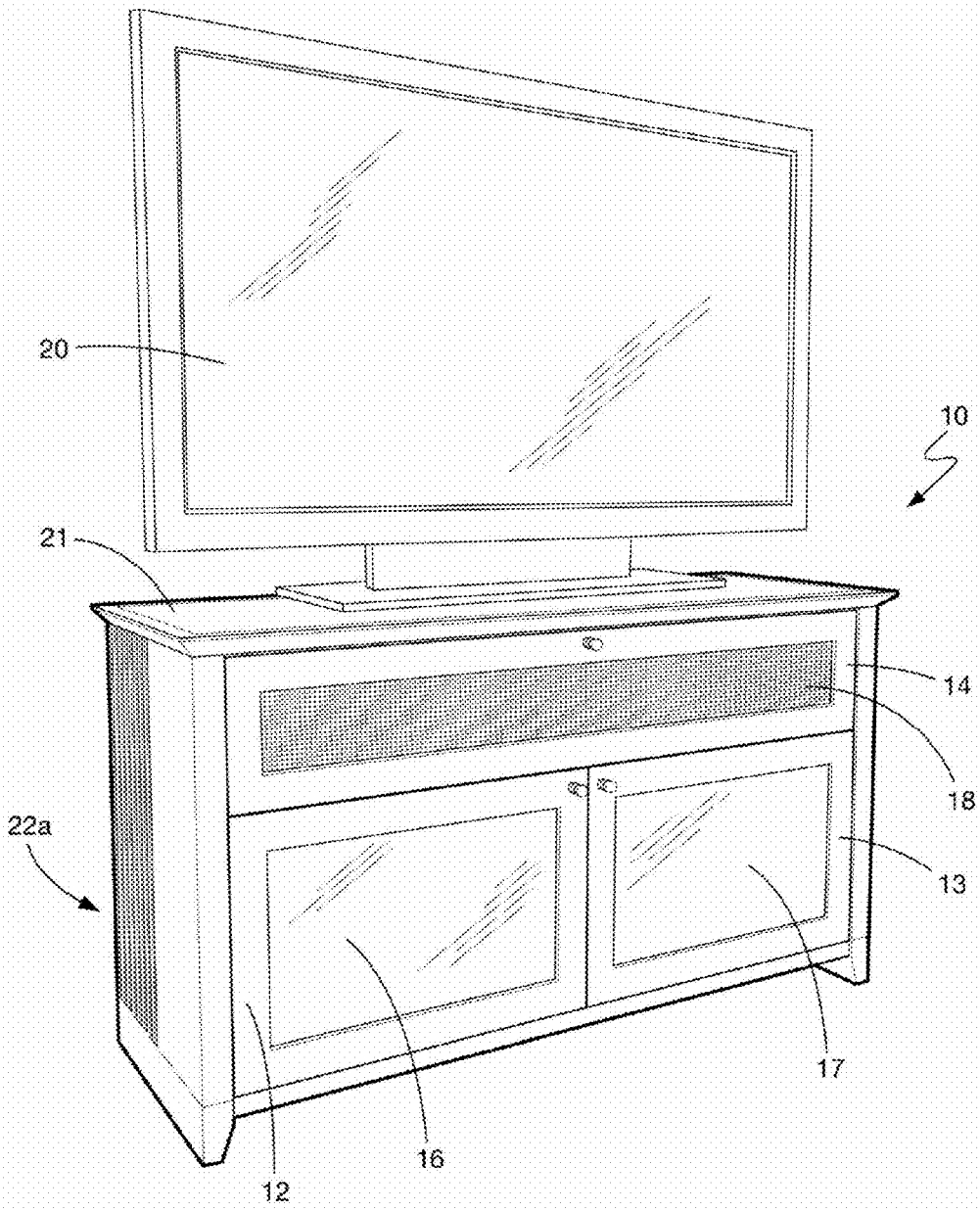
FIG. 1 is a front perspective view of one embodiment of the unit.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It should be understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features. As used herein, when a first element or portion of the inventive device "communicates with" or is "in communication with" a second element or portion of the inventive device, air is able to pass between the first and second elements or portions of the inventive device.

In one respect, the invention comprises a furniture unit for concealing a subwoofer and other audiovisual (A/V) components. Generally, the front side of the unit includes one or more doors that allow access to one or more internal compartments. The rear side of the unit includes a compartment that allows for insertion of a subwoofer. One or more vent openings located on the side of the unit allows for air to enter and exit the subwoofer without restriction, thereby minimizing any negative effect on the operation of the subwoofer, while generally concealing the subwoofer from view.

Referring to FIGS. 1-13, several embodiments of a furniture unit according to the present invention are shown. While a detailed description may be provided for portions of only one embodiment, those skilled in the art will recognize that, for other embodiments that may include the same or similar features, the description pertains to those embodiments as well.

Referring generally to FIGS. 1-6, one embodiment of the unit 10 is shown. A television 20 is shown supported on the top surface 21 of the unit 10. It should be understood that any type of A/V device or other object may be situated on the top surface 21. The top surface 21 may be comprised of glass, wood, a scratch-resistant coating, a rubber matting, or any other suitable material. Preferably, the top surface 21 is sufficiently thick to support a device situated thereon. In this embodiment, the front face of the unit 10 comprises a first door 12, a second door 13, and a center door 14. First door 12 and second door 13 contain and support screens 16, 17, respectively. Center door 14 contains and supports screen 18. In this embodiment, screens 16, 17 are comprised of tinted glass panels that allow for the transmission of infrared ("IR") or other signals while partially concealing items located behind the doors 12, 13. In this embodiment, screen 18 is comprised of an opaque fabric material that allows for sound waves to freely pass through without being distorted or dampened, while concealing the contents of the compartment located behind the door 14.

It should be understood that the front side of the unit 10 may comprise any number of doors within the scope of this invention. Moreover, the one or more doors may contain and support screens of any type of material, and in any number of possible combinations, within the scope of this invention. In the alternative, the screens may be omitted entirely, and the one or more doors may be comprised of a solid panel of wood or other suitable material.

Figure 2:
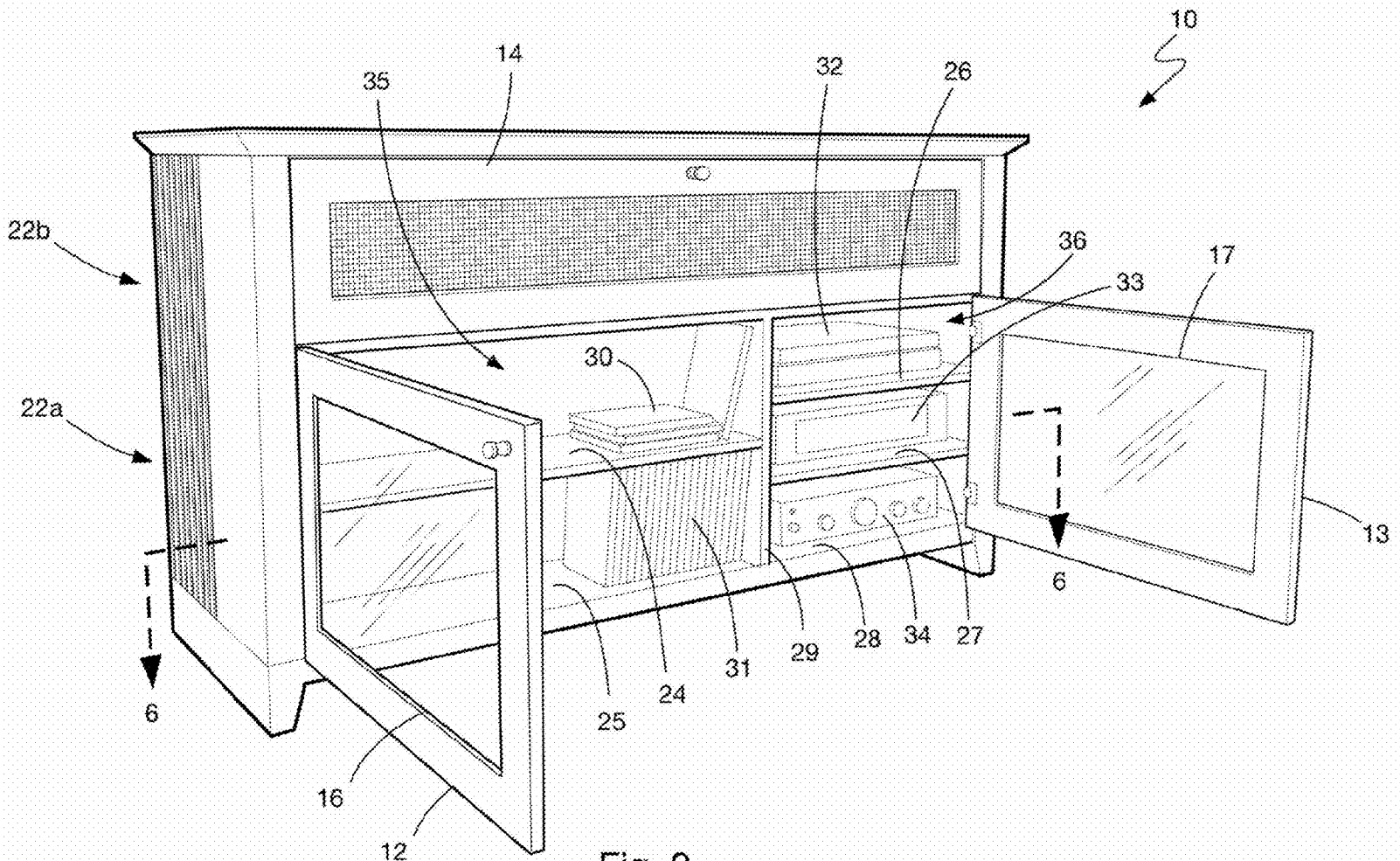
FIG. 2 is a front perspective view of the unit with the first and second doors open.
Figure 3:
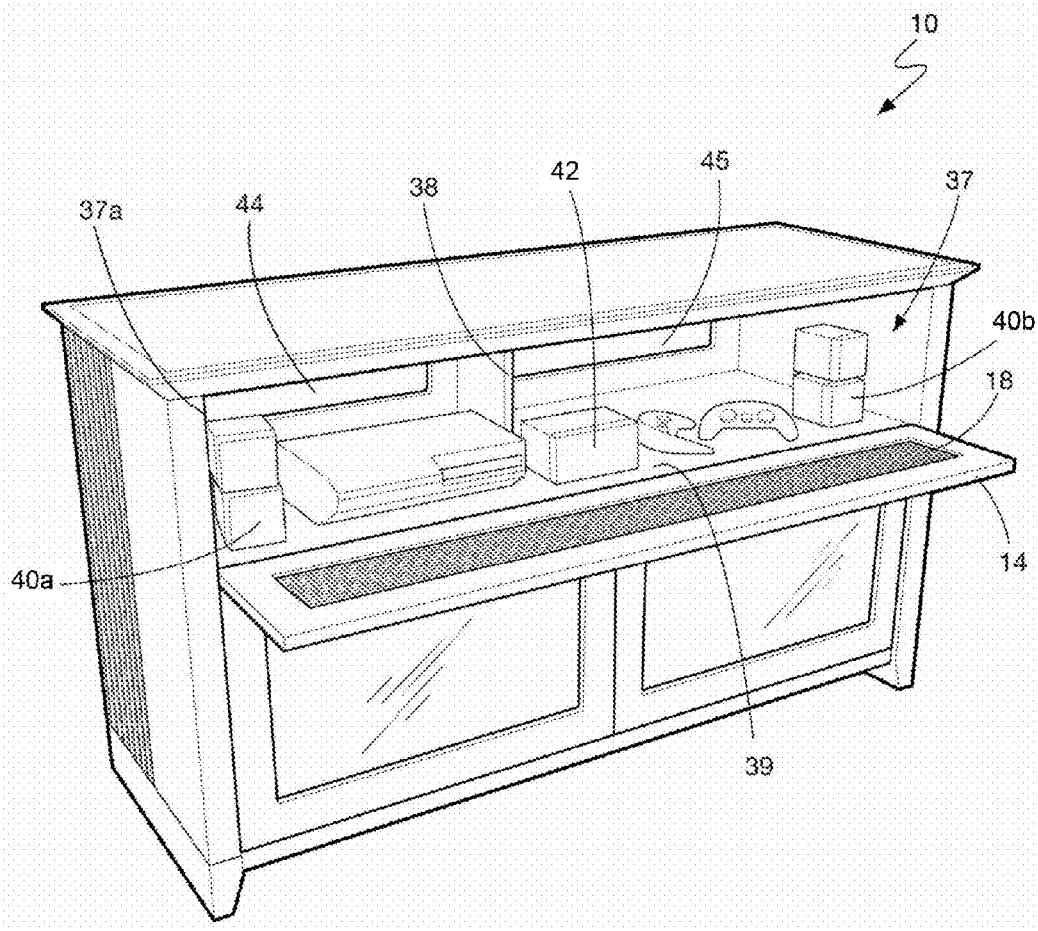
FIG. 3 is a front perspective view of the unit with the center door open.

In this embodiment, as best seen in FIGS. 2 and 3, the first door 12 and the second door 13 open in a direction towards the respective side of the unit 10 to which it is hinged, and the center door 14 opens in a direction towards the bottom of the unit 10, i.e., away from the top surface 21. It should be understood that doors 12-14 could open in any direction, or each door could open alternatively in different directions, within the scope of this invention. The doors 12-14 could also be of different sizes, for example, the first door 12 and the second door 13 may be of unequal width (as measured from left to right in FIG. 1).

Figure 6:
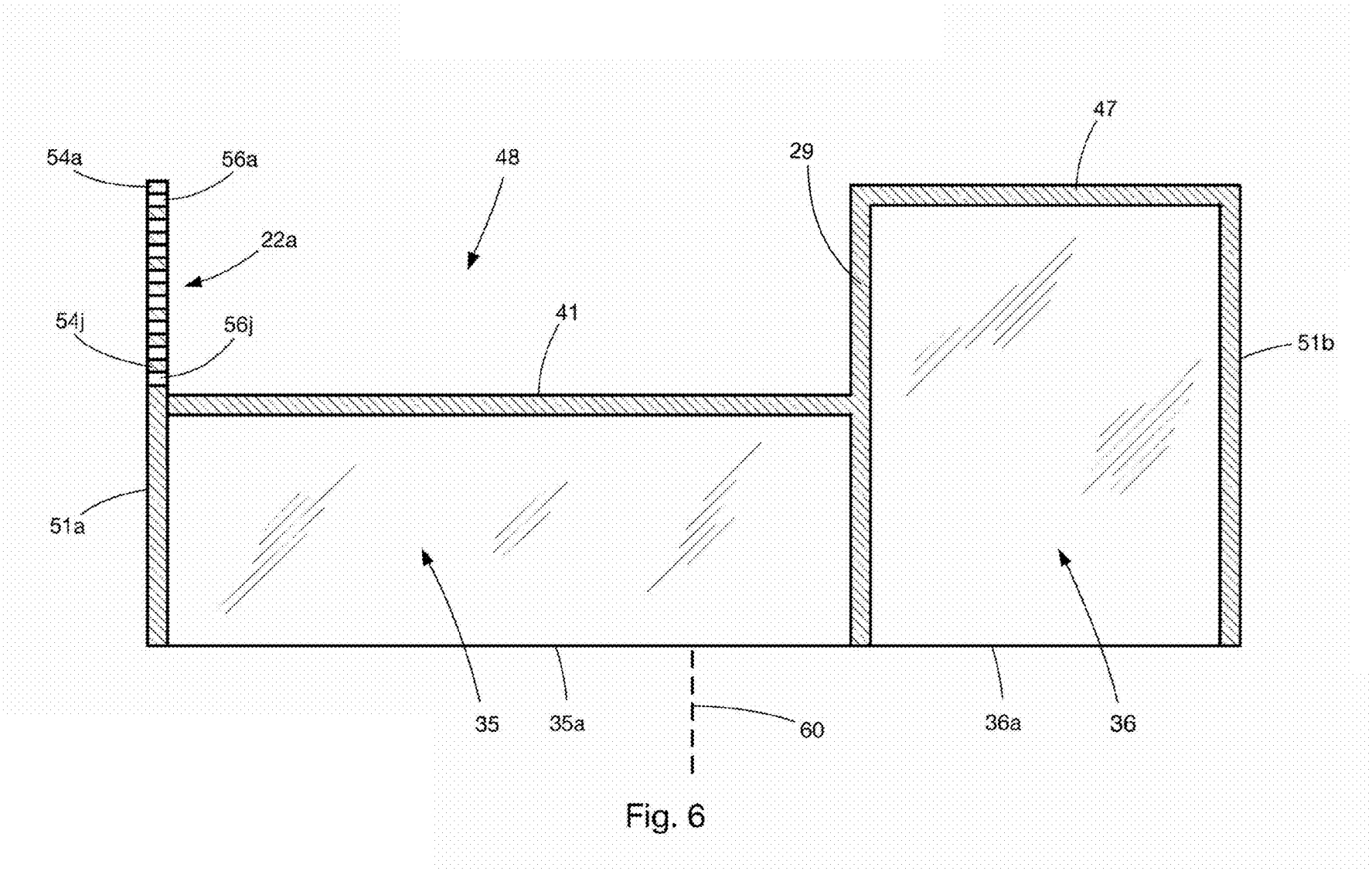
FIG. 6 is a sectional view taken along line 6-6 of FIG. 2.

In this embodiment, the first door 12, the second door 13, and the center door 14 generally conceal a first compartment 35, a second compartment 36, and a center compartment 37, respectively. First compartment 35 is a shallow-depth compartment that is located anterior to a subwoofer compartment 48 (shown in FIG. 4) and has an IR-passive screen 16 located anterior thereto when door 12 is closed. Referring to FIG. 6, first compartment 35 has an open face 35*a* that can be covered by first door 12 when first door 12 is closed. A divider 41 separates the first compartment 35 from the subwoofer compartment 48. The depth of the first compartment 35 is measured from the divider 41 to the face 35*a*. The door 12 is operable between an open position wherein the first compartment 35 is accessible and a closed position wherein the first compartment 35 is not accessible.

The depth of the unit 10 is measured from the first face 35*a* to the rear wall 47. The width of the unit 10 is measured between first and second side walls 51*a*, 51*b*.

The second compartment 36 extends adjacent the first compartment 35 and the subwoofer compartment 48 to a side portion of a rear wall 47 of the unit 10 and has a depth corresponding approximately with the full depth of the unit 10. The second compartment 36 has an open face 36*a* that is coplanar with the face 35*a* of the first compartment 35. The depth of the second compartment 36 is measured from the rear wall 47 to the face 36*a*. The second compartment 36 also has an IR-passive screen 17 located anterior thereto when door 13 is closed.

Referring to FIG. 3, the center compartment 37 also has a depth corresponding approximately with the full depth of the unit 10, and extends from the face 35*a* to the rear wall 47 above each of the first compartment 35, the second compartment 36, and the subwoofer compartment 48. The center compartment 37 has an open face 37*a* that is coplanar with the face 35*a* of the first compartment 35. The door 14 is operable between an open position wherein the center compartment 37 is accessible and a closed position wherein the center compartment 37 is not accessible. The center compartment 37 also has an opaque, sound-transmissive screen 18 located anterior thereto when door 14 is closed. The faces 35*a*, 36*a*, 37*a* are opposite to the rear wall 47, i.e. located on an opposite side of the unit 10 from the rear wall 47.

In this embodiment, the center compartment 37 is located above the subwoofer compartment 48, i.e., the center compartment 37 is located between the top surface 21 and the subwoofer compartment 48. The first compartment 35 includes shelves 24, 25 on which objects 30, 31, respectively, may be placed. The second compartment 36 contains shelves 26-28 on which objects 32-34, respectively, may be placed. It should be understood that any number and arrangement of shelves may be included in the first compartment 35 and the second compartment 36 within the scope of this invention. In this embodiment, divider 29 separates the first compartment 35 and the second compartment 36 from each other. The first compartment 35, the second compartment 36, the center compartment 37, and the subwoofer compartment 48, as well as any shelves contained therein, may each have cable-passage holes, slots, or other passageways that allow for components placed in the various compartments to be connected to another.

In this embodiment, as best seen in FIG. 3, the center compartment 37 is comprised of a shelf 39 having a depth corresponding approximately with the full depth of the unit 10, and which may hold components such as speakers 40 *a,b* and 42. It should be understood that the center compartment 37 could comprise any number and arrangement of shelves within the scope of this invention. In this embodiment, the top portion of the rear wall 47 that makes up the center compartment 37 comprises rear holes 44, 45 separated by a support member 38. The rear holes 44, 45 are in communication with the center compartment 37. The rear holes 44, 45 allow heat generated by components located in the center compartment 37 to escape from the rear side of the unit 10 and enable cables to be run to and from the center compartment 37. Where the screen 18 is comprised of a porous material, such as a fabric, air is able to ventilate through the screen 18, the center compartment 37, and then out one of the rear holes 44, 45, or the air may ventilate in the reverse direction. In this embodiment, the support member 38 is centrally located within the center compartment 37, and provides structural support to the top surface 21 and any objects placed thereon, such as television 20. In the alternative, additional support members may be included within the center compartment 37, or one or more reinforcing bars (not shown) may be placed in the top panel of the unit 10 to provide structural support. The support member 38 also may be omitted entirely.

Figure 4:
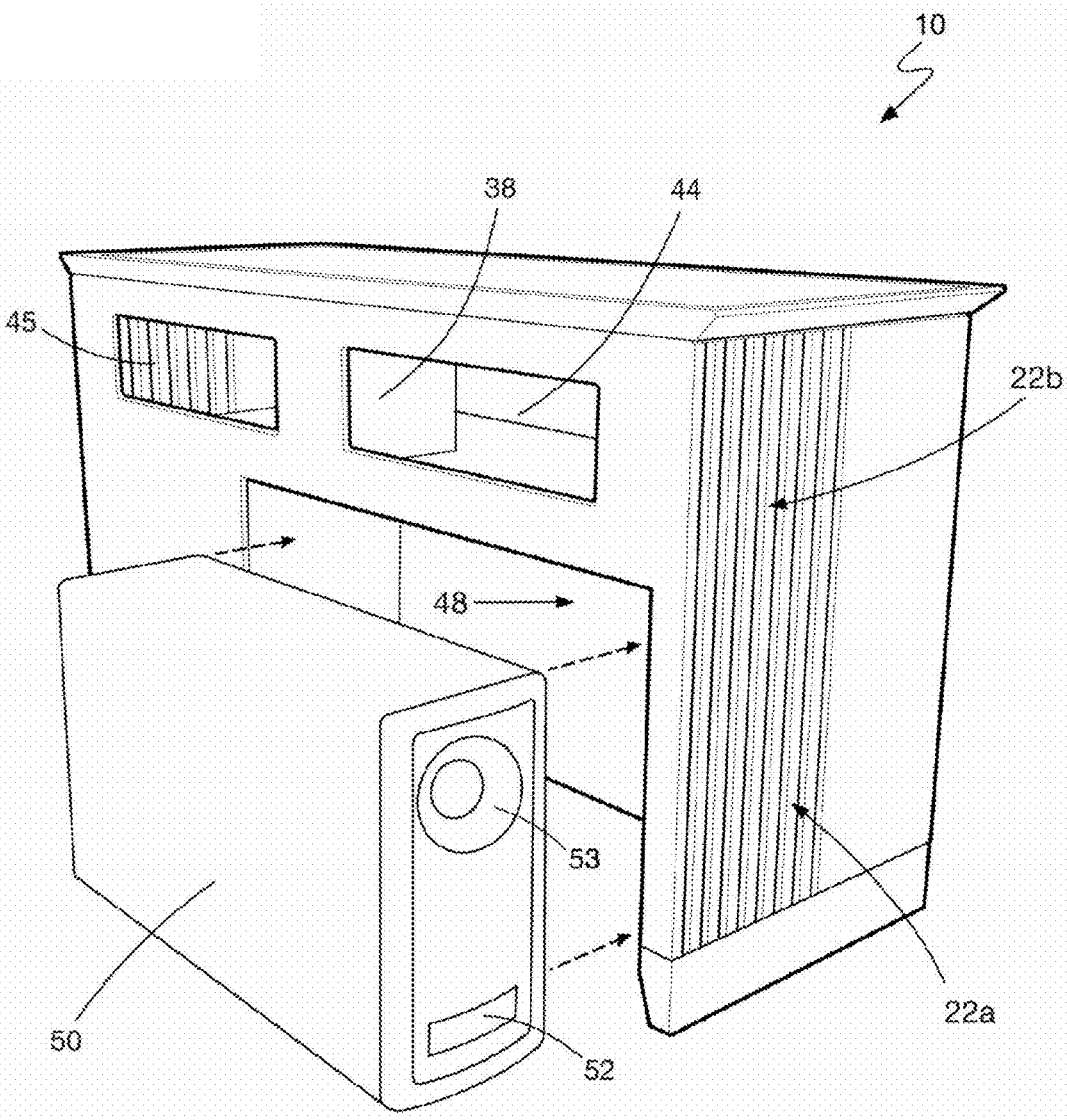
FIG. 4 is a rear perspective view of the unit showing the subwoofer compartment.

As can best be seen in FIG. 4, in this embodiment the rear wall 47 of the unit 10 defines, i.e. includes, a cut-out region or rear wall opening 49 that communicates with the subwoofer compartment 48. The rear wall opening 49 has a height and width which are approximately or exactly the same as the height and width of the subwoofer compartment 48. First and second side walls 51*a*, 51*b* extend forwardly from the rear wall 47 such that rear wall 47 and first and second side walls 51*a*, 51*b* support the top surface 21. The first compartment 35 and the second compartment 36 extend between the first and second side walls 51*a*, 51*b*. In the alternative, less than all of the side walls 51*a*, 51*b* and the rear wall 47 could provide support to the top surface 21.

The divider 41 extends parallel to the rear wall 47 and the front face 35*a* such that the first compartment extends between the face 35*a* and the divider 41 and the subwoofer compartment 48 extends between the divider 41 and the rear wall opening 49. The distance between the rear wall 47 and the divider 41 define the depth of the subwoofer compartment 48, and the distance between the first side wall 51*a* and the divider 29 define the width of the subwoofer compartment 48.

The subwoofer compartment 48 accommodates the insertion of a subwoofer 50 as shown by the dashed arrows in FIG. 4. In practice, the subwoofer 50 is typically placed in the desired location, such as on a surface near a wall 58 (see FIG. 5) and the unit 10 is then moved toward the wall 58 along the surface until the subwoofer 50 is fully contained within the subwoofer compartment 48, thus allowing the unit 10 to be placed directly against the wall 58. Alternatively, the subwoofer 50 may be placed only partially within the subwoofer compartment 48. Preferably, as in this embodiment, the subwoofer compartment 48 has an open bottom, so that the subwoofer 50 sits directly on the floor when it is inserted into the subwoofer compartment 48. This design prevents the subwoofer from vibrating the unit 10, and by extension the television 20 or other components located in or on the unit 10. Alternatively, the subwoofer compartment 48 may include a bottom support (not shown), which supports the subwoofer 50 and prevents it from touching the floor. The bottom support may include means for dampening vibration created by the subwoofer 50, such as padding, springs, or the like.

In this embodiment, the subwoofer compartment 48 has dimensions of approximately one-half of the depth (measured from the front side to the rear side), two-thirds of the height (measured from the bottom to the top surface 21), and approximately two-thirds of the width (measured from left to right in FIG. 1) of the unit 10. As can be seen in FIG. 4, these dimensions correspond approximately with the size of the subwoofer 50. In some embodiments, it may be desirable to limit the width and depth of the subwoofer compartment 48 to no more than the above-noted fractions of the overall width and depth of the unit 10. In additional embodiments, a subwoofer compartment 48 having any possible dimensions could be used within the scope of this invention. The subwoofer compartment 48 could be sized so as to accommodate a particular model or product line of subwoofers, or sized generically so as to accommodate a range of common subwoofer dimensions.

Referring back to FIGS. 3 and 6, it can be seen that in this embodiment the first compartment 35 has approximately the same width (measured from left to right) as the subwoofer compartment 48. The first compartment 35 is located anterior to the subwoofer compartment 48, and the cumulative depth of the first compartment 35 and the subwoofer compartment 48 corresponds approximately with the depth of the unit 10. Second compartment 36 has a depth that corresponds approximately with the depth of the unit 10. Center compartment 37 has a depth and width that correspond approximately with the depth and width, respectively, of the unit 10. This arrangement is preferable because it maximizes the space available within the unit 10. Alternatively, the first compartment 35 could have a width that is greater than the subwoofer compartment 48, or the second compartment 36 or center compartment 37 could each have a depth that is shallower than the depth of the unit 10. It should be understood that minimization of the dimensions of the subwoofer compartment 48 maximizes the dimensions of the first compartment 35, second compartment 36, and center compartment 37. However, in order to prevent vibration of the unit 10, and to allow for proper airflow as discussed below, the subwoofer 50 preferably should not come in contact with the unit 10. Therefore, the subwoofer compartment 48 should have sufficient clearance on all sides for accommodation of the subwoofer 50, as well as any other subwoofer that the unit 10 is designed to accommodate.

Some modern A/V systems use multiple subwoofers as part of the surround sound system. In another embodiment (not shown), the unit could be equipped with more than one subwoofer compartment. If multiple subwoofer compartments are included, it is most preferable that each subwoofer compartment terminate at one side of the unit where a vent-containing portion is located, as further described below.

Referring back to the embodiment shown in FIGS. 1-6, vent openings 56*a*-56*j* located in a vent-containing portion 22*a* (see FIGS. 4 and 5) on the first side wall 51*a* of the unit 10 are in communication with the subwoofer compartment 48 to allow air to flow in and out of the subwoofer compartment 48. The vent openings 56*a*-56*j* provide an unobstructed path for the ports 52, 53 of the subwoofer 50 to inspire and expire air, while the subwoofer 50 remains generally concealed from the view of a person sitting within a typical viewing angle A of the television 20, i.e. within approximately 85 degrees of a center line 60 (see FIG. 6) drawn perpendicular to the front side of the unit 10 at a midpoint thereof. Preferably, at least one of the ports 52, 53 of the subwoofer 50 are aligned with the vent-containing portion 22*a*.

Figure 5:
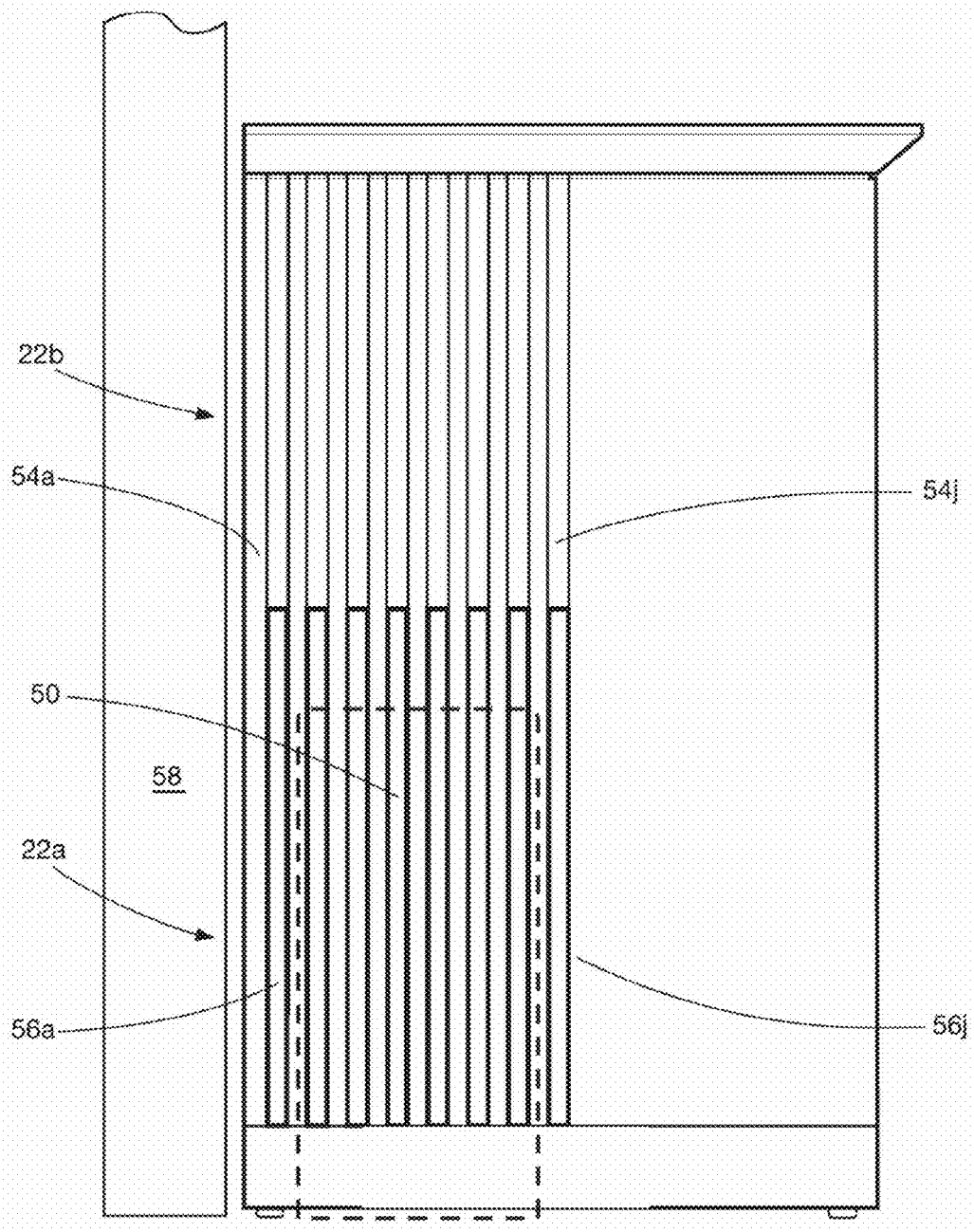
FIG. 5 is a side orthogonal view of the unit showing the vent-containing portion.

Referring now to FIG. 5, one embodiment of the vent-containing portion 22*a* is shown. In this embodiment, members 54*a*-54*j* extend vertically from the bottom of the unit 10 to the top surface 21, and are spaced apart so as to define vent openings 56*a*-56*j* in the area of the vent-containing portion 22*a*. For ease of illustration, only members 54*a*, 54*j* and vent openings 56*a*, 56*j* are labeled in FIG. 5. In this embodiment, the members 54*a*-54*j* extend vertically approximately from the bottom to the top surface 21 of the unit 10, thereby creating a non vent-containing, or unvented, portion 22*b* above the vent-containing portion 22*a*, and so as to create an aesthetically-pleasing appearance when the unit 10 is viewed from typical viewing angles. It should be understood that the members 54*a*-54*j* need not extend above the vent-containing portion 22*a*. In this embodiment, the second side wall 51*b* of the unit 10 (not depicted) may include an identical or matching set of vertical members (without vent openings) for aesthetic purposes (i.e. to match the appearance of the members 54*a*-54*j* of the first side wall 51*a*). In the alternative, as discussed above, where multiple subwoofer compartments are included in the unit, it is preferable that each of the subwoofer compartments abut respective vent-containing portions. These vent-containing portions may be located on opposite sides of the unit, or on the same side of the unit.

The vent openings 56*a*-56*j* allow airflow between the subwoofer compartment 48 and the exterior of the unit 10, while concealing the subwoofer 50 from the view of a person sitting within a typical viewing angle of the television, as discussed above. Preferably, as in this embodiment, the vent openings 56*a*-56*j* are located in the side wall of the unit 10. Less preferably, the vent-containing portions could be located in the front or rear wall of the unit.

As best seen in FIG. 5, in this embodiment the widths of the individual members 54*a*-54*j* and vent openings 56*a*-56*j* are approximately equal. It should be understood that the members 54*a*-54*j* and vent openings 56*a*-56*j* could exist in any number of shapes, sizes, quantities, configurations, or orientations, or any various combination thereof, within the scope of this invention. For example, the members or vent openings could be horizontally or diagonally oriented, or the unit could include a single vent opening of any desired shape. Alternatively, the vent openings 56*a*-56*j* could be left open or concealed with fabric or other opaque, sound-transmissive fabric. Preferably, the size, spacing, and orientation of the members 54*a*-54*j* and vent openings 56*a*-56*j* are selected so as to allow for adequate airflow through the vent openings 56*a*-56*j* while providing sufficient concealment of the subwoofer 50 within the subwoofer compartment 48 at typical viewing angles. Alternatively, it should be understood that the vent-containing portion 22*a* could be configured so as to focus on maximizing either airflow properties or subwoofer concealment, at the expense of the other attribute.

FIG. 6 depicts a cross-sectional view along line 6-6 of FIG. 2. Exemplary relative length and width dimensions of the first compartment 35, the second compartment 36, and the subwoofer compartment 48 can be seen. The members 54*a*-54*j* and vent openings 56*a*-56*j* are also shown in cross-section. For ease of illustration, only members 54*a*, 54*j* and vent openings 56*a*, 56*j* are labeled in FIG. 6.

Figure 7:
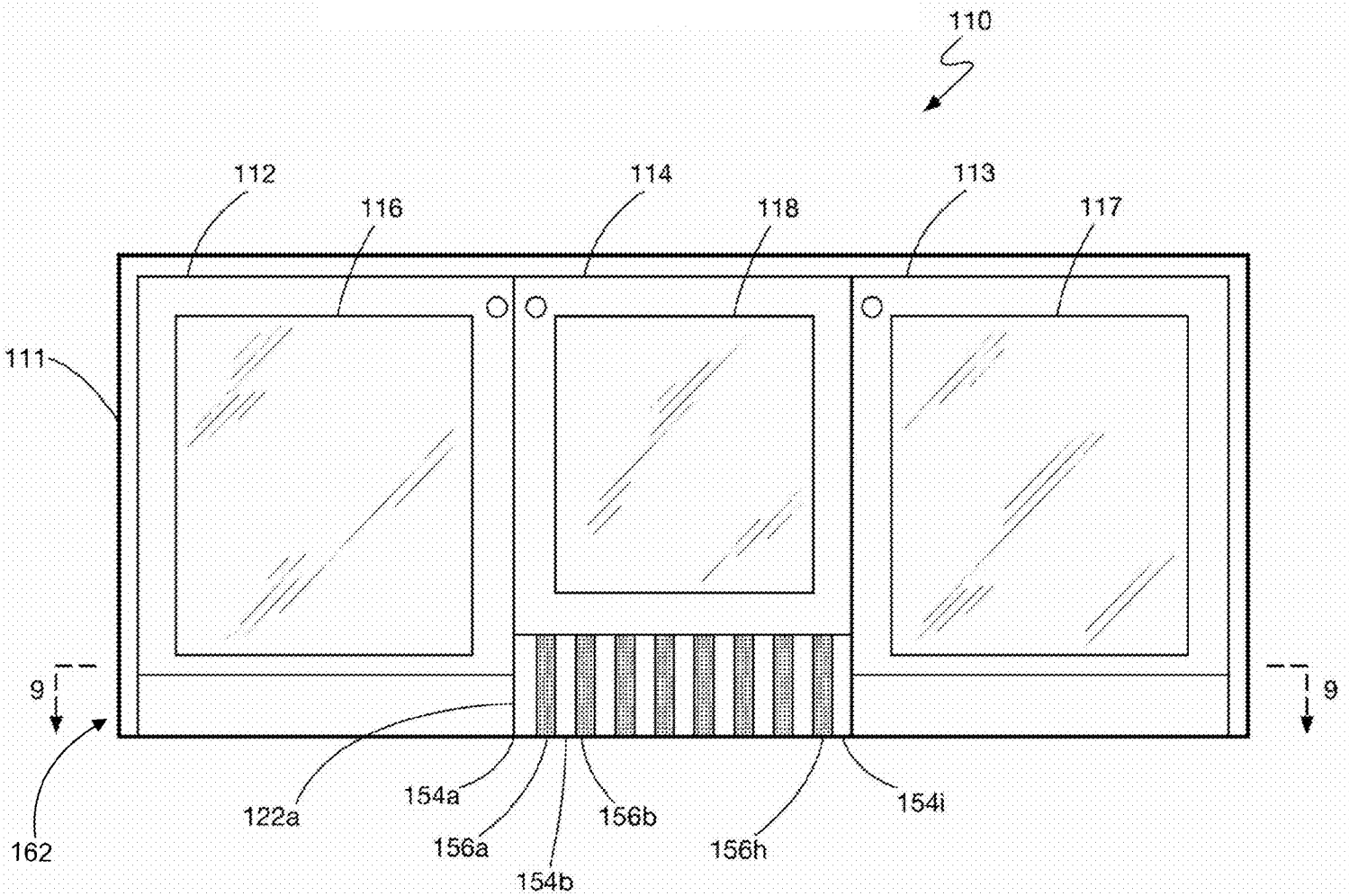
FIG. 7 is a front orthogonal view of an alternative embodiment of the unit.
Figure 8:
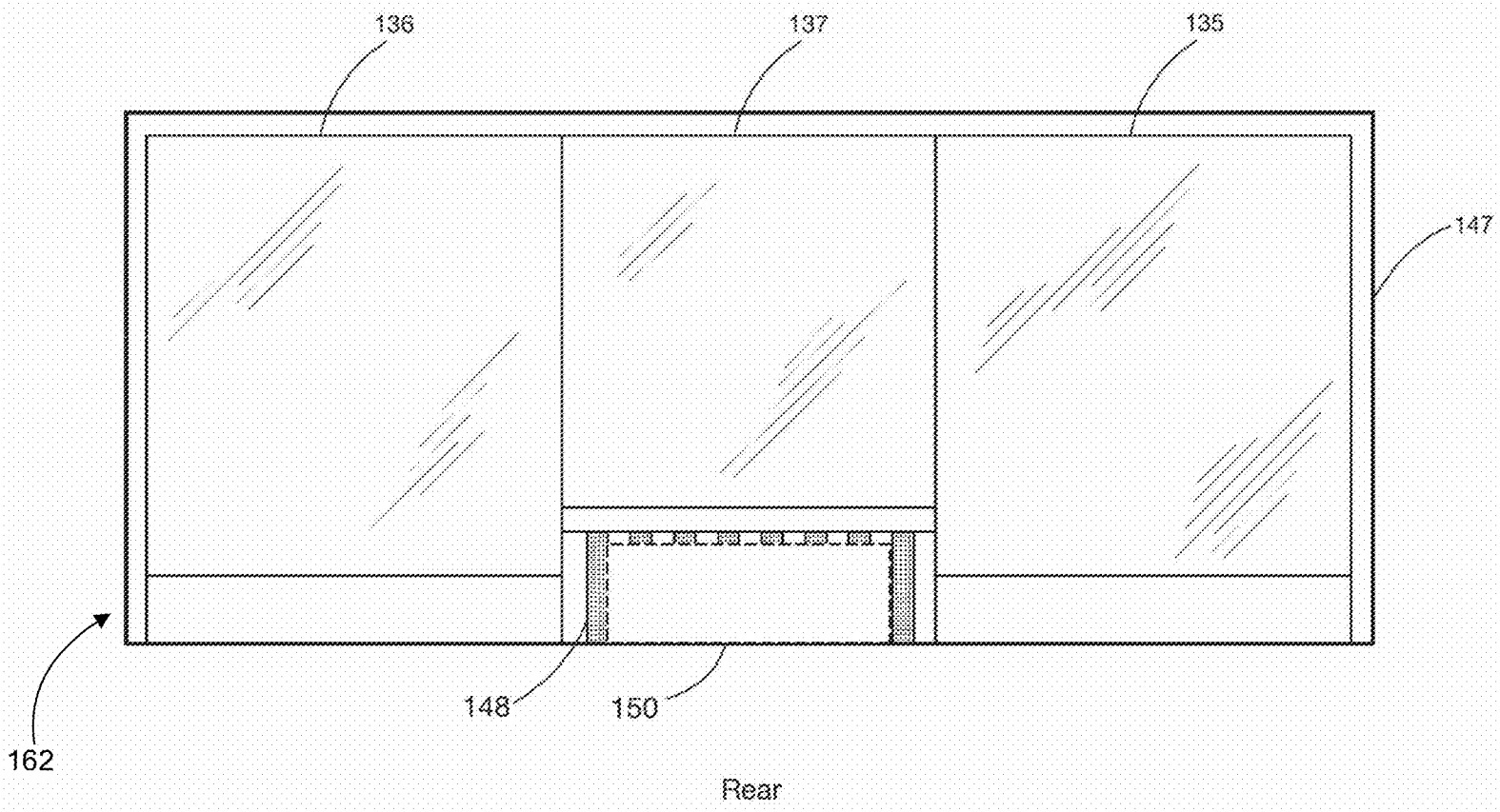
FIG. 8 is a rear orthogonal view of the unit of FIG. 7.
Figure 9:
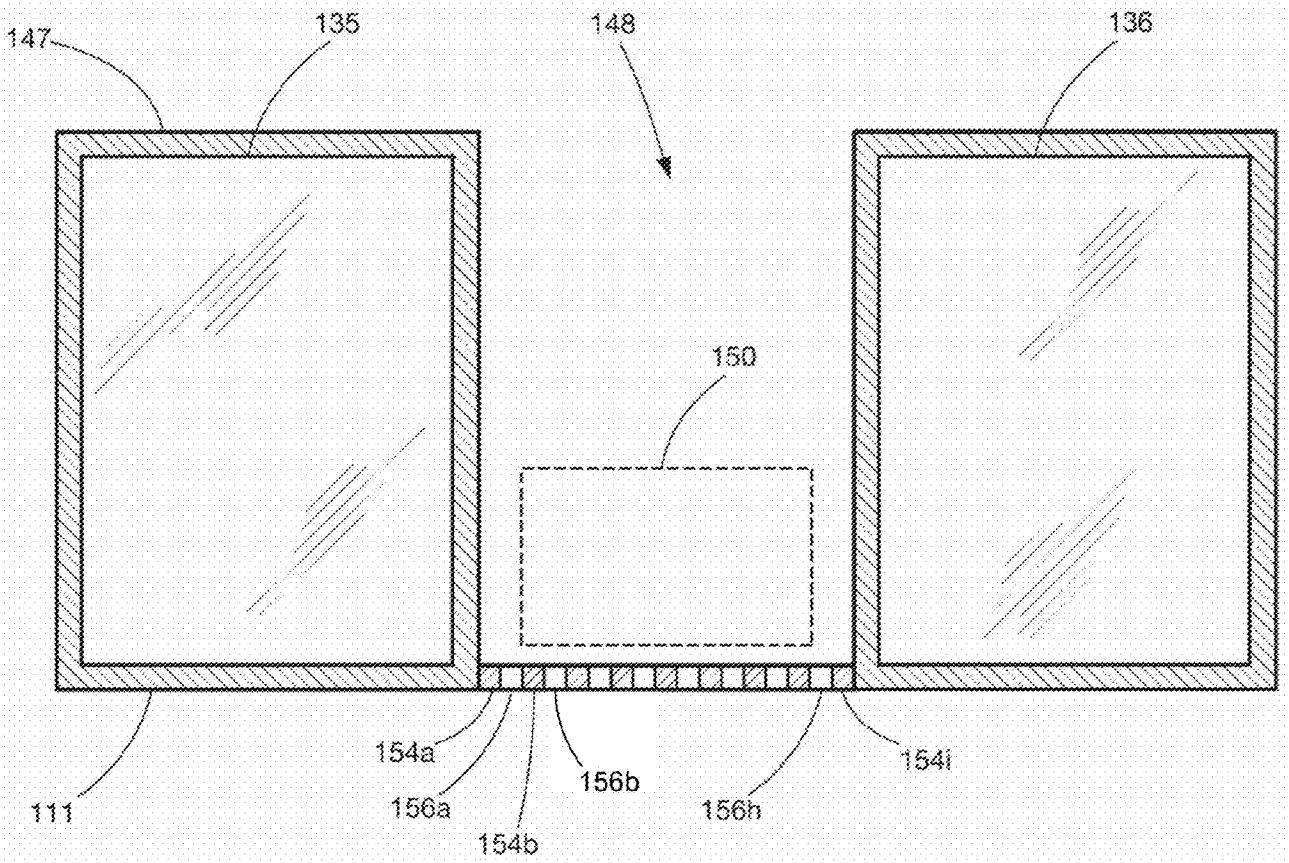
FIG. 9 is a sectional view of the unit take along line 9-9 of FIG. 7.

An alternative embodiment of a unit 110 according to the present invention is illustrated in FIGS. 7-9. In this embodiment, elements shared with the first exemplary embodiment are represented by reference numerals increased by factors of 100. For example, the unit 10 of the first embodiment corresponds to the unit 110 of the second embodiment. Referring to FIGS. 7 and 8, unit 110 includes a first door 112, a second door 113, and a center door 114. First door 112 and second door 113 contain and support screens 116, 117, respectively. Center door 114 contains and supports a screen 118. In this embodiment, screens 116, 117, 118 may be comprised of tinted glass panels that allow for the transmission of IR or other signals therethrough while partially concealing items located behind the doors 112, 113, 114. It should be understood that the front side of the unit 110 may comprise any number of doors within the scope of this invention. Moreover, the one or more doors may contain and support screens of any type of material, and in any number of possible combinations, within the scope of this invention.

In this embodiment, the first door 112, the second door 113, and the center door 114 generally conceal a first compartment 135, a second compartment 136, and a center compartment 137, respectively. Dividers (not shown) may separate the first compartment 135, the second compartment 136, and the center compartment 137 from adjacent compartments. In this embodiment, each of the compartments 135, 136,137 is a full-depth compartment that extends from the front 111 of the unit 110 to the rear wall 147 of the unit 110. Although not shown, each compartment 135, 136, 137 may have at least one or more shelves for storing items thereon. Each shelf may extend from the front 111 to the rear 147 of the unit 110.

A subwoofer compartment 148 is located below the center compartment 137 in the plinth portion 162 of the unit 110. The subwoofer compartment 148 is preferably open to the floor and may have a relatively low height relative to the overall height of the unit 110. The height of the subwoofer compartment 148 may be about 8 inches, which is sufficient for particular models of a subwoofer 150, for example, a Yamaha Model YST-FSW050 subwoofer, to fit within the subwoofer compartment 148. As shown in FIG. 9, the subwoofer compartment 148 is open at the rear 147 of the unit 110. This opening allows the subwoofer 150 to be placed in a desired position on a floor and the unit 110 to be slid over top of the subwoofer 150. Alternatively, the subwoofer compartment 148 could extend across the entire width of the plinth portion 162 of the unit 110.

Referring to FIGS. 7 and 9, vent openings 156*a*-156*h* are located in a vent-containing portion 122*a* located on the front 111 of the unit 110. Vent openings 156*a*-156*h* are in communication with the subwoofer compartment 148 to allow air to flow in and out of the subwoofer compartment 148. The vent openings 156*a*-156*h* provide an unobstructed path for the subwoofer 150 to inspire and expire air.

Members 154*a*-154*i* extend vertically approximately from the bottom of the unit 110 to the bottom of the center door 114 and are spaced apart so as to define vent openings 156*a*-156*h* in the area of the vent-containing portion 122*a*. For ease of illustration, only members 154*a*, 154*b*, and 154*i* and vent openings 156*a*, 156*b*, and 156*h* are labeled in FIGS. 7 and 9. The vent openings 156*a*-156*h* allow airflow between the subwoofer compartment 148 and the exterior of the unit 110, while concealing the subwoofer 150 from the view of a person sitting in front of the unit 110. The vent openings 156*a*-156*h* may be covered with a fabric material that allows sound waves to pass freely through without being distorted or dampened, while concealing the subwoofer 150 located in the subwoofer compartment 148 from view. In alternate embodiments, a fabric panel could be used instead of the vent openings.

Figure 10:
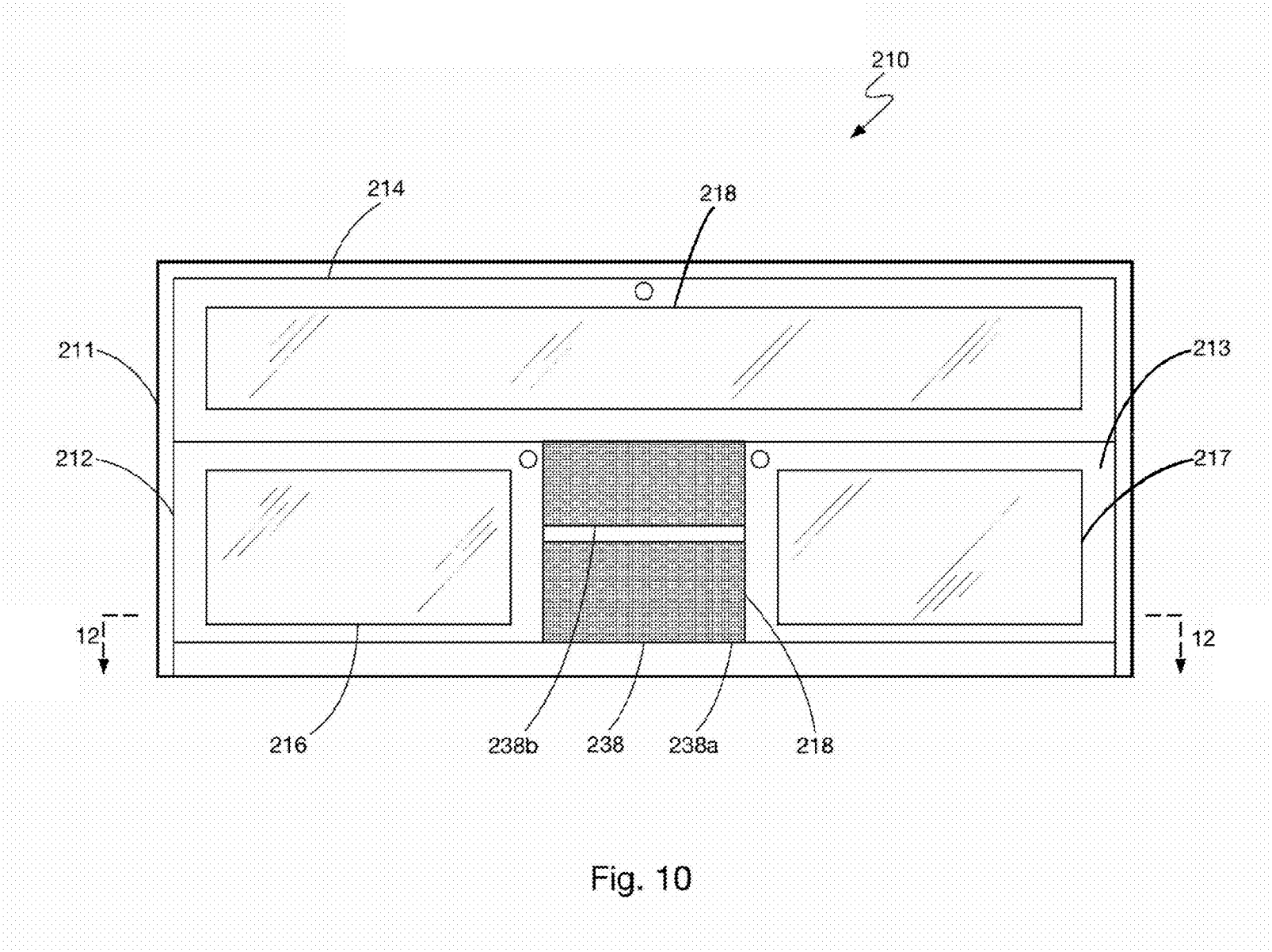
FIG. 10 is a front orthogonal view of an alternative embodiment of the unit.
Figure 11:
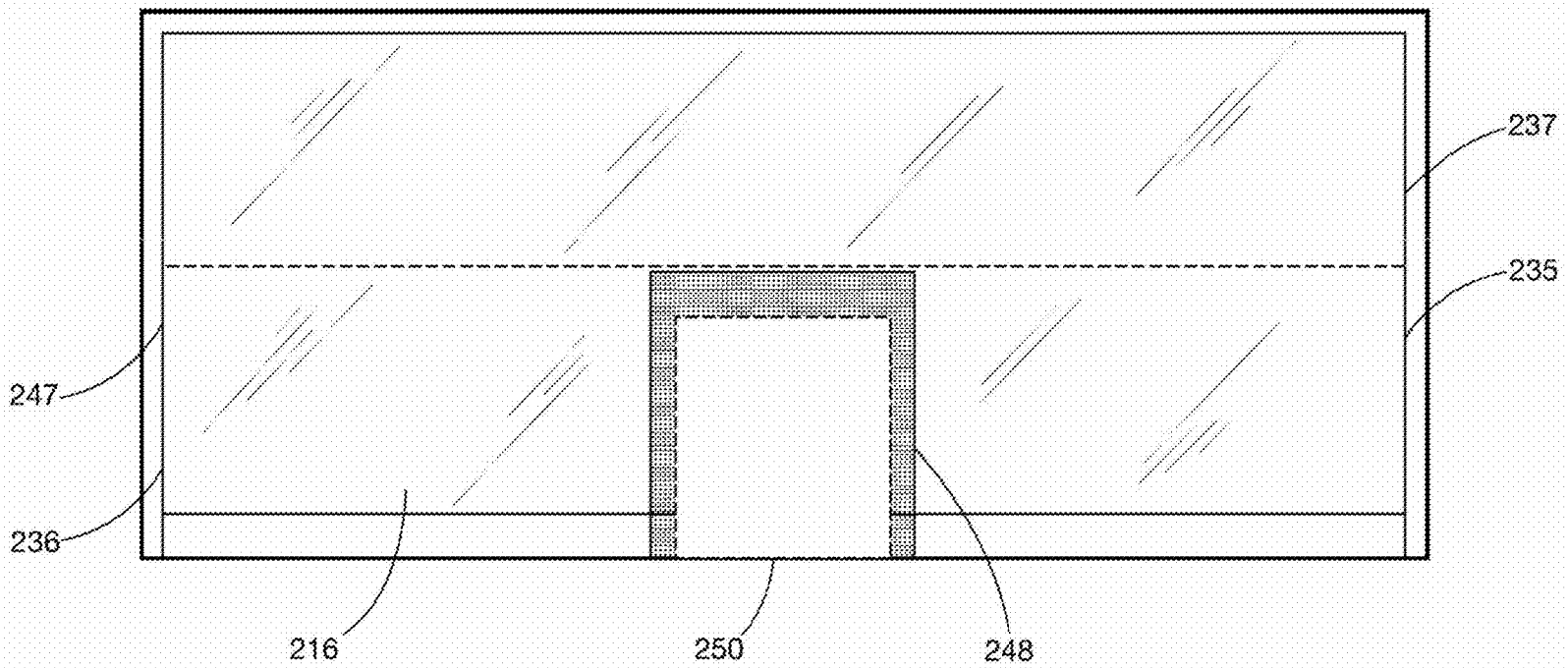
FIG. 11 is a rear orthogonal view of the unit of FIG. 10.
Figure 12:
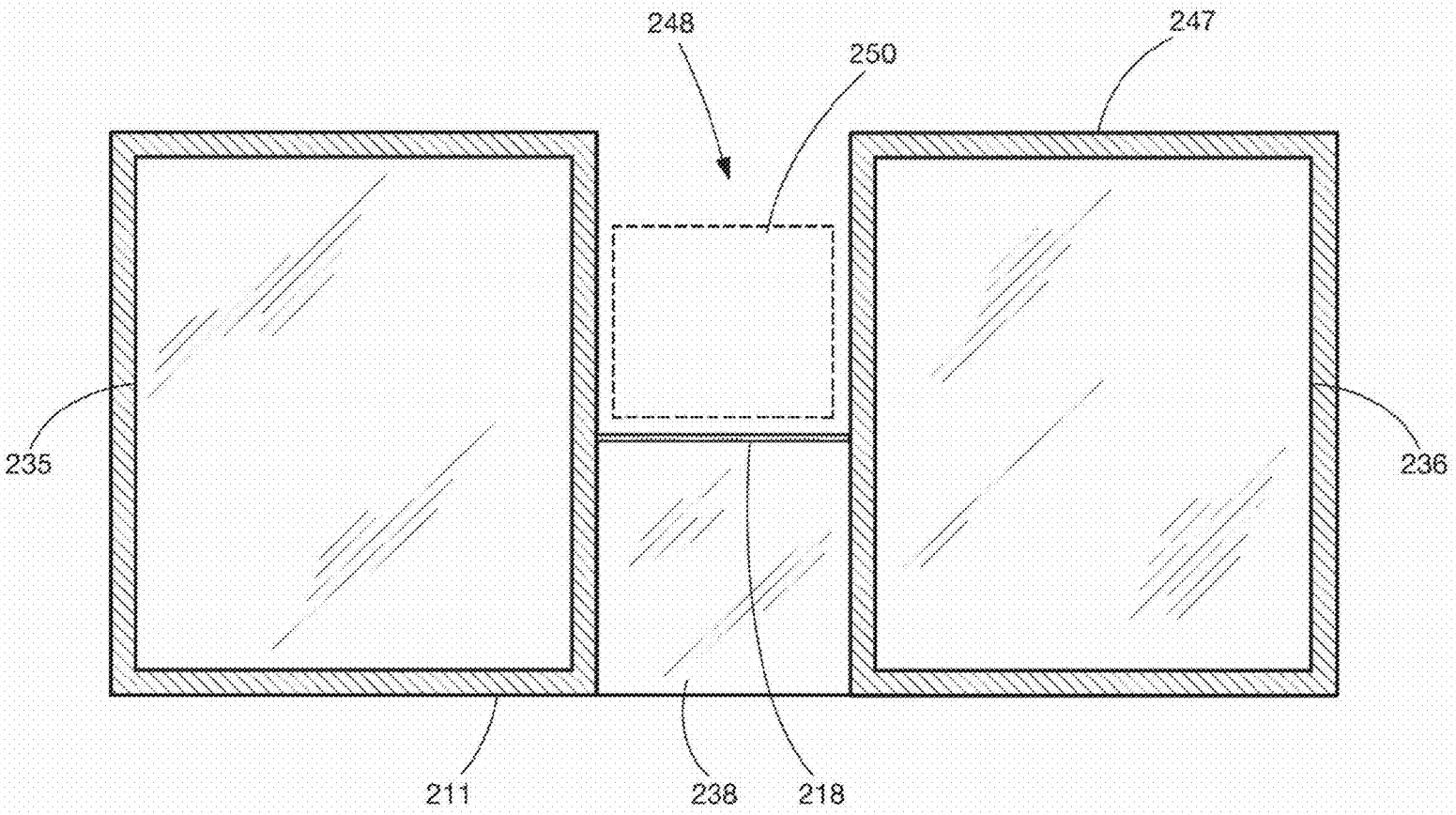
FIG. 12 is a sectional view of the unit taken along line 12-12 of FIG. 10.

A third embodiment of a unit 210 according to the present invention is illustrated in FIGS. 10-12. In this embodiment, elements shared with the first exemplary embodiment are represented by reference numerals increased by factors of 200. For example, the unit 10 of the first embodiment corresponds to the unit 210 of the third embodiment.

Referring to FIG. 10, unit 210 includes a first door 212, a second door 213, and a center door 214. First door 212 and second door 213 contain and support screens 216, 217, respectively. Center door 214 contains and supports screen 218. In this embodiment, screens 216, 217, 218 may be comprised of tinted glass panels that allow for the transmission of IR or other signals while partially concealing items located behind the doors 212, 213, 214.

In this embodiment, referring to FIGS. 10 and 11, the first door 212, the second door 213, and the center door 214 generally conceal a first compartment 235, a second compartment 236, and a center compartment 237, respectively. An open compartment 238 is located between the first compartment 235 and the second compartment 236, below the center compartment 237. The open compartment 238 may include one or more shelves. In the embodiment illustrated, two shelves 238*a*, 238*b* are shown. Shelves 238*a*, 238*b* may be used to store game consoles, multimedia devices, and the like (not shown). The open compartment 238 does not include a door so that game consoles can easily be accessed during operation.

As illustrated in the sectional view of FIG. 12, the first compartment 235 and the second compartment 236 extend between the front 211 and the rear 247 of the unit 210. Although not shown, the center compartment 237 extends the entire length of the unit 210 and between the front 211 and the rear 247 of the unit 210. Referring further to FIG. 12, the open compartment 238 is a shallow-depth compartment that extends only partially toward the rear 247 of the unit 210, allowing for a subwoofer compartment 248 to extend between the open compartment and the rear 247 of the unit 210. The subwoofer compartment 248 has an open bottom that extends from the floor to the bottom of the center compartment 237, and is sufficiently large for a subwoofer 250 to be located therein, as shown in FIGS. 11 and 12. As shown in FIG. 12, the subwoofer compartment 248 is open at the rear 247 of the unit 210. This opening allows the subwoofer to be placed in a desired position on a floor and the unit 210 to be slid over top of the subwoofer 250.

The subwoofer compartment 250 and the open compartment 238 may be separated from each other by a fabric material 218 that allows sound waves to pass freely through without being distorted or dampened, while concealing the subwoofer 250 located in the subwoofer compartment 248 from the view of a person seated in front of the unit 210.

Figure 13:
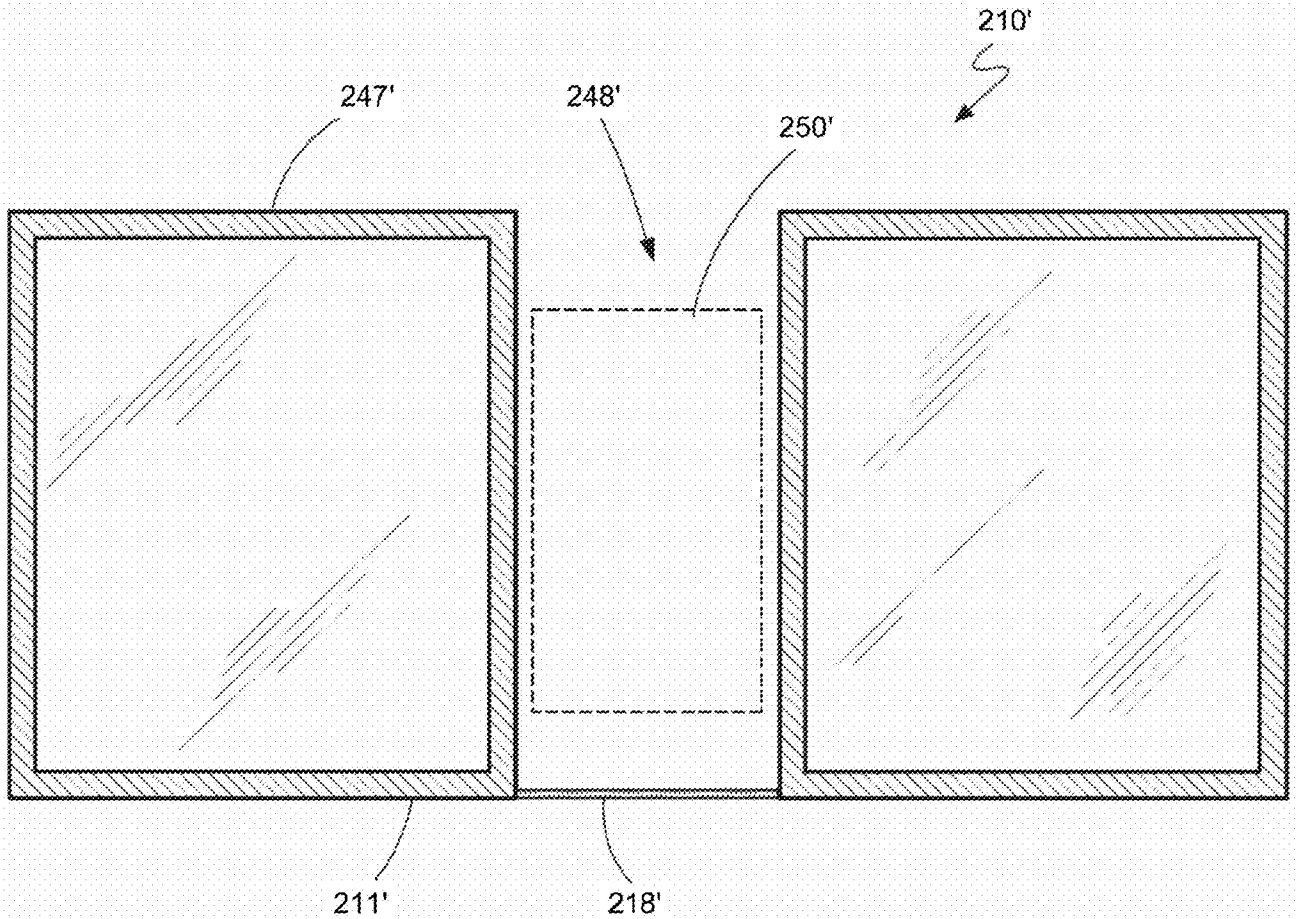
FIG. 13 is a top sectional view of an alternative embodiment of the unit.

FIG. 13 shows a top sectional view of an alternative embodiment of a unit 210'. It should be understood that this embodiment of the unit 210' is similar to the previous embodiment of a unit 210, except that the open compartment is omitted from the unit 210', thereby forming a subwoofer compartment 248' that extends between the front 211' and rear 247' of the unit 210'. It should be understood that the view of FIG. 13 is taken along a line drawn in a similar location to the line 12-12 of FIG. 10. In this embodiment, a fabric material 218' extends across the subwoofer compartment 248' at the front 211' of the unit 210', thereby concealing the subwoofer 250' from view.

While the principles of the invention have been described above in connection with preferred embodiments, it is to be clearly understood that this description is made only by way of example and not as a limitation of the scope of the invention.

The invention claimed is:

1. A furniture unit comprising:

a rear wall defining a rear wall opening;

first and second side walls extending forwardly from the rear wall, a first divider located between the first and second side walls;

a top surface located atop the rear wall and the first and second side walls and being supported by at least one selected from the group of: the rear wall, the first side wall and the second side wall;

a first compartment located between the first and second side walls, the first compartment having a first face that is opposite to the rear wall, a distance from the first face to the rear wall defining a unit depth, a distance from the first side wall to the second side wall defining a unit width; and a subwoofer compartment located between the first compartment and the rear wall, the subwoofer compartment communicating with the rear wall opening and having an open bottom, the subwoofer compartment being separated from the first compartment by a second divider, a distance from the rear wall to the second divider defining a subwoofer compartment depth, a distance from the first side wall to the first divider defining a subwoofer compartment width, wherein the first side wall has a vented portion comprising at least one vent opening in communication with the subwoofer compartment.

2. The furniture unit according to claim 1, wherein the at least one vent opening comprises a plurality of vent openings defined by a first set of members.

3. The furniture unit according to claim 2, wherein the first set of members extend upwardly to the top surface.

4. The furniture unit according to claim 2, further comprising a second set of members located on the second side wall, the second set of members being substantially identical in spacing and shape to the first set of members.

5. The furniture unit according to claim 2, further comprising a center line that is located at a midpoint between the first side wall and the second side wall, the center line being parallel to the first and second side walls, the first set of members concealing the subwoofer compartment from a person viewing the furniture unit from a position located at an angle of no greater than 85 degrees from the center line.

6. The furniture unit according to claim 1, wherein the first side wall comprises an unvented portion located above the vented portion.

7. The furniture unit according to claim 1, further comprising a second compartment located between the second side wall and the first compartment, the second compartment extending from the rear wall to a third face that is coplanar with the first face.

8. The furniture unit according to claim 1, wherein the rear wall opening has an opening width that is equal to the subwoofer compartment width.

9. The furniture unit according to claim 1, further comprising a center compartment located between the first compartment and the top surface, the center compartment extending from a second face to the rear wall, the second face being coplanar with the first face.

10. The furniture unit according to claim 9, wherein the first compartment has a first compartment width that is equal to the subwoofer compartment width.

11. The furniture unit according to claim 9, wherein the center compartment is located between the subwoofer compartment and the top surface.

12. The furniture unit according to claim 1, wherein the subwoofer compartment depth is no greater than one half of the unit depth.

13. The furniture unit according to claim 1, wherein the subwoofer compartment width is no greater than two-thirds of the unit width.

14. A method of concealing a subwoofer, the method comprising:

positioning the furniture unit of claim 1 on a surface; and positioning the subwoofer on the surface and at least partially within the subwoofer compartment.

15. The method according to claim 14, further comprising:

positioning the subwoofer so that a port located in the subwoofer is aligned with a vent portion located on the first side wall of the furniture unit.

16. A furniture unit comprising:

a rear wall defining a rear wall opening;

a first side wall, a second side wall and a second divider extending forwardly from the rear wall and being perpendicular to the rear wall, the second divider being located between the first side wall and the second side wall;

a top surface located atop the rear wall and the first and second side walls and being supported by the rear wall, the first side wall and the second side wall;

a first compartment located between the first side wall and the second divider, the first compartment having a first face that is opposite to the rear wall, a distance from the first face to the rear wall defining a unit depth, a distance from the first side wall to the second side wall defining a unit width;

a subwoofer compartment located between the first side wall and the second divider and between the first compartment and the rear wall, the subwoofer compartment communicating with the rear wall opening and having an open bottom, the subwoofer compartment being separated from the first compartment by a first divider that is parallel to the rear wall, the first side wall having a vented portion comprising at least one vent opening in communication with the subwoofer compartment, a distance from the rear wall to the first divider defining a subwoofer compartment depth, a distance from the first side wall to the second divider defining a subwoofer compartment width;

a second compartment located between the second divider and the second side wall, the second compartment extending from the rear wall to a third face that is coplanar with the first face; and a center compartment located above the first compartment, the subwoofer compartment, and the second compartment, the center compartment extending from the rear wall to a second face that is co-planar with the first face.

17. The furniture unit according to claim 16, wherein the vent portion comprises a plurality of vent openings defined by a first set of members.

18. The furniture unit according to claim 17, wherein the first side wall comprises an unvented portion located above the vented portion.

19. The furniture unit according to claim 17, further comprising a second set of members located on the second side wall, the second set of members being substantially identical in spacing and shape to the first set of members.

* * * * *